US008959871B2

(12) United States Patent
Parenti et al.

(10) Patent No.: US 8,959,871 B2
(45) Date of Patent: Feb. 24, 2015

(54) MODULAR POST COVERS

(76) Inventors: Chris Parenti, Novi, MI (US); Loren Venegas, Canton, MI (US)

( * ) Notice: Subject to any disclaimer, the term of this patent is extended or adjusted under 35 U.S.C. 154(b) by 1300 days.

(21) Appl. No.: 12/399,530

(22) Filed: Mar. 6, 2009

(65) Prior Publication Data

US 2010/0223882 A1 Sep. 9, 2010

(51) Int. Cl.
*E04C 3/36* (2006.01)
*E04F 19/00* (2006.01)
*E04F 11/18* (2006.01)

(52) U.S. Cl.
CPC . *E04F 19/00* (2013.01); *E04C 3/36* (2013.01); *E04F 11/1842* (2013.01)
USPC ..... 52/741.3; 52/170; 52/834

(58) Field of Classification Search
USPC ..... 52/169.3, 169.4, 170, 590.2, 592.1, 52/745.17, 834, 741.3
See application file for complete search history.

(56) References Cited

U.S. PATENT DOCUMENTS

| | | | | | |
|---|---|---|---|---|---|
| 999,267 | A * | 8/1911 | Slick | 29/463 |
| 2,191,248 | A * | 2/1940 | Cappel | 405/216 |
| 2,354,485 | A * | 7/1944 | Slaughter | 52/578 |
| 3,291,437 | A * | 12/1966 | Bowden et al. | 249/48 |
| 3,355,852 | A * | 12/1967 | Lally | 52/834 |
| 4,019,301 | A * | 4/1977 | Fox | 52/834 |
| 4,023,374 | A * | 5/1977 | Colbert et al. | 405/216 |
| 4,114,388 | A * | 9/1978 | Straub | 405/216 |
| 4,125,394 | A * | 11/1978 | Wilson | 71/9 |
| 5,458,942 | A * | 10/1995 | Miller | 428/76 |
| 5,987,845 | A * | 11/1999 | Laronde | 52/845 |
| 6,006,488 | A * | 12/1999 | Okitomo | 52/834 |
| 6,094,881 | A * | 8/2000 | Lockwood | 52/845 |
| 6,167,672 | B1 * | 1/2001 | Okitomo | 52/834 |
| 6,286,281 | B1 * | 9/2001 | Johnson | 52/592.1 |
| D465,585 | S | 11/2002 | Venegas, Jr. | |
| 6,694,692 | B2 * | 2/2004 | Piccone | 52/426 |
| D521,656 | S * | 5/2006 | Terrels | D25/122 |
| 7,300,229 | B1 * | 11/2007 | Fyfe et al. | 405/216 |
| 7,325,790 | B2 * | 2/2008 | Lee | 256/65.14 |
| 7,818,939 | B2 * | 10/2010 | Bearinger et al. | 52/591.1 |
| 2005/0229531 | A1 * | 10/2005 | Green et al. | 52/736.1 |
| 2006/0010824 | A1 * | 1/2006 | Waters et al. | 52/738.1 |
| 2006/0185270 | A1 * | 8/2006 | Handley et al. | 52/169.14 |
| 2008/0072510 | A1 * | 3/2008 | Wells et al. | 52/251 |

* cited by examiner

*Primary Examiner* — Adriana Figueroa
(74) *Attorney, Agent, or Firm* — Gifford, Krass, Sprinkle, Anderson & Citkowski, P.C.

(57) ABSTRACT

A modular system includes a plurality of polymeric panels, each panel having a thickness, a length, and first and second opposing parallel side edges defining a width. The first side edge of each panel includes a lengthwise receptacle, while the second side edge of each panel including a lengthwise bead. The bead and receptacle are physically dimensioned such that the receptacle of one panel receives the bead of another panel in interlocking cooperation, thereby enabling multiple panels to be interconnected to surround a vertical member. In one embodiment, each elongated receptacle includes a lengthwise cylindrical cavity having an inner diameter accessed through a lengthwise slot having a width less than the diameter of the cavity. Each elongated bead is a lengthwise cylindrical bead having an outer diameter corresponding to the inner diameter of the cavity, such that the bead is received by the cavity. A different embodiment uses interlocking barbs.

1 Claim, 4 Drawing Sheets

MODULAR POST COVERS

FIELD OF THE INVENTION

This invention relates generally to covers for posts, stanchions, columns, and the like and, in particular, to a modular cover that may be configured for different sizes and applications.

BACKGROUND OF THE INVENTION

There are many different types of covers for posts, stanchions, columns, and the like. One such cover, having a smooth cylindrical sidewall and a dome-shaped top, is disclosed and claimed in commonly assigned U.S. Design Pat. No. D465,585.

One drawback with unitary covers of this type is that they require relatively large plastic molding equipment. Even if inexpensive 'blow-molding' processes are used, different covers need to be produced and inventoried in different sizes or for different applications.

SUMMARY OF THE INVENTION

This invention solves problems with part fabrication and stocking by providing a modular system for covering a vertical member. The system includes a plurality of polymeric panels, each panel having a thickness, a length, and first and second opposing parallel side edges defining a width. The first side edge of each panel includes a lengthwise receptacle, while the second side edge of each panel including a lengthwise bead. The bead and receptacle are physically dimensioned such that the receptacle of one panel receives the bead of another panel in interlocking cooperation, thereby enabling multiple panels to be interconnected to surround a vertical member.

In one embodiment, each elongated receptacle includes a lengthwise cylindrical cavity having an inner diameter accessed through a lengthwise slot having a width less than the diameter of the cavity. Each elongated bead is a lengthwise cylindrical bead having an outer diameter corresponding to the inner diameter of the cavity, such that the bead is received by the cavity.

According to a different embodiment, each elongated receptacle includes a lengthwise cavity accessed through an lengthwise slot defined by two opposing edges, at least one of the edges including the first portion of a barb structure, Each elongated bead in this case includes a lengthwise edge defining a second portion of the barb structure, such when the bead is received by the slot the first and second portions of the barb structure interlocking with one another.

The modular cover system may include panels of differing widths. The modular cover system may include flexible panels that may be bent around a vertical member or panels that are bent lengthwise at an angle to form corner panels. For example, corner panels may bend lengthwise at an angle of substantially 90 degrees to form a cover having a square cross section. In the preferred embodiments the panels have a length of 2 to 12 feet and a width of 2 inches to 12 inches. The panels are preferably extruded from a polymeric material and may include in-die colorants and/or UV protection. Methods of covering a vertical member with the panels are also disclosed herein.

DETAILED DESCRIPTION OF THE INVENTION

Figure 1:
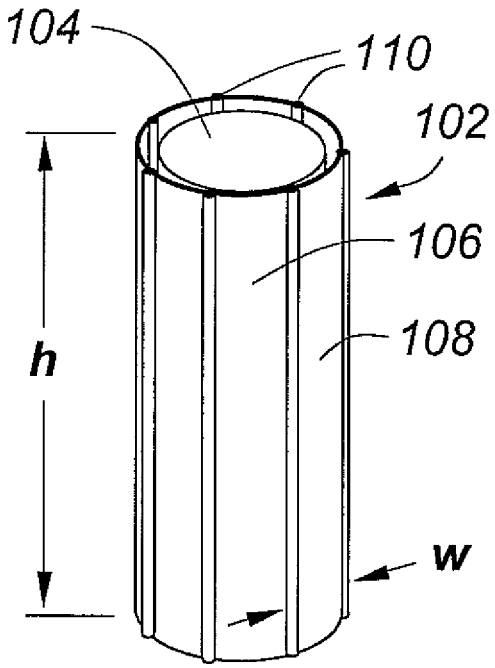
FIG. 1 is an oblique view showing what a cover according to the invention would look like on an upright, vertical member.

FIG. 1 is an oblique view showing what a cover 102 according to the invention would look like on an upright, vertical member 104. The cover is comprised of a plurality of panels 106, 108, each with two elongated sides edges defining a width 'w' and a height 'h.' It is anticipated that the width 'w' is on the order of 2 to 12 inches or thereabouts, with the height 'h' of each panel being in the range of 2 to 12 feet. Each panel has a thickness in the range of 1/16" to 3/8" and more preferably on the order of 0.10"

Each panel is preferably extruded from Polyethylene (high, medium, or low density), though other plastic/polymeric materials may alternatively be used, including Polypropylene, Styrene (Crystal and nigh-impact), ABS, Butyrate, Polycarbonate, Nylon, Noryl, PVC (flexible, semi-rigid, or rigid), Geloy, Ultem, Acetate, Urethane, TPE (also known as TPV or TPR), and fluorinated thermoplastics such as PVDF and PEP.

Although FIG. 1 shows panels formed into a cylindrical shape to cover a cylindrical post, the invention is not limited in that covers with square, triangular or other cross-sections may be constructed, and the cross section of the cover may be different from the cross section of the post (i.e., a square cover may be used on a round post).

Figure 2A:
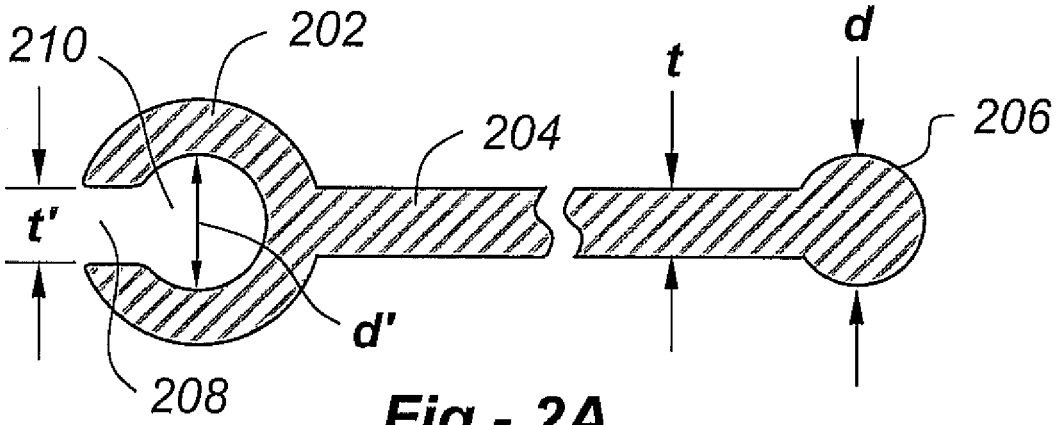
FIG. 2A is a cross section of one panel interlocking mechanism according to the invention.
Figure 2B:
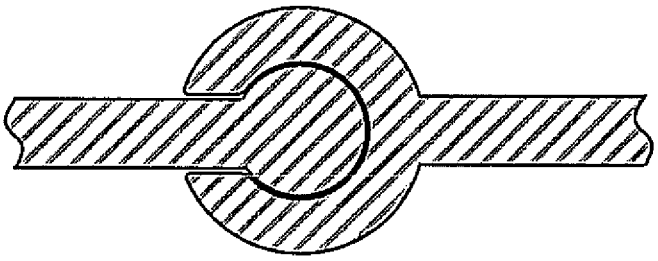
FIG. 2B shows the edges of two panels interlocked using the interlocking mechanism of FIG. 2A.

The edges of each panel 106, 108 include a lengthwise panel interlocking mechanism 110 that will now be discussed in further detail. FIG. 2A, for example, is a cross section of one panel interlocking mechanism according to the invention, and FIG. 2B shows the edges of two panels interlocked using the interlocking mechanism of FIG. 2A. This embodiment is directed to a panel having one edge with a C-shaped cross section 202 defining a lengthwise cylindrical channel 210 and an opposing, parallel edge with a lengthwise cylindrical bead 206.

Assuming the thickness 't' of wall portion 204 is on the order of 0.1", the diameter 'd' of bead 206 may be on the order of 0.2" The inner diameter 'd' of the channel 210 is preferably slightly larger than 'd' and may be 0.25" for example. A gap 208 into the channel has a width t' slightly greater than t. For example, a gap on the order of 0.120 inches may be used. Using dimensions such as these, a tight but workable interconnection is achieved from panel to panel, as shown in FIG. 2B.

Depending upon the material used and wall thickness, the panels according to the invention may be flexible enough to be snapped together. For example, bead 206 may be used to spread gap t' to be received by the channel 210. More typically, however, particularly if thicker, less flexible materials or dimensions are used, the bead of one panel will be slid into the channel of another in sequence until construction of the cover is completed.

Figure 3A:
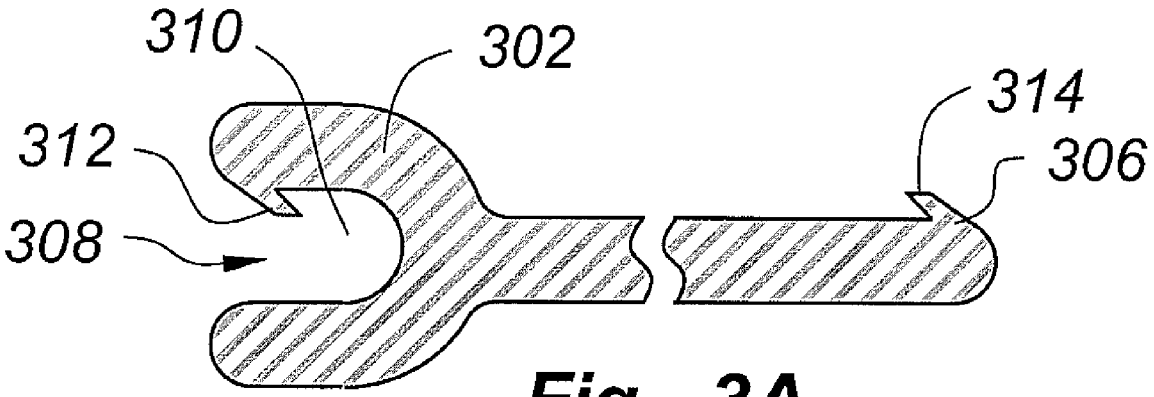
FIG. 3A is a cross section of an alternative panel interlocking mechanism according to the invention.
Figure 3B:
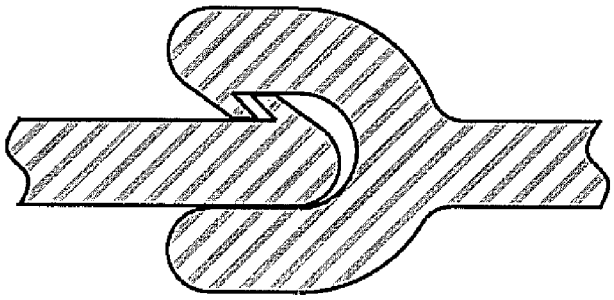
FIG. 3B shows the edges of two panels interlocked using the interlocking mechanism of FIG. 3A.
Figure 3C:
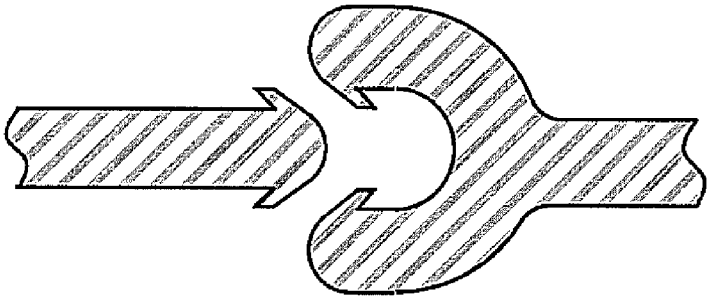
FIG. 3C is a cross section of a further alternative panel interlocking mechanism wherein each edge includes a pair of interlocking barbs.
Figure 5:
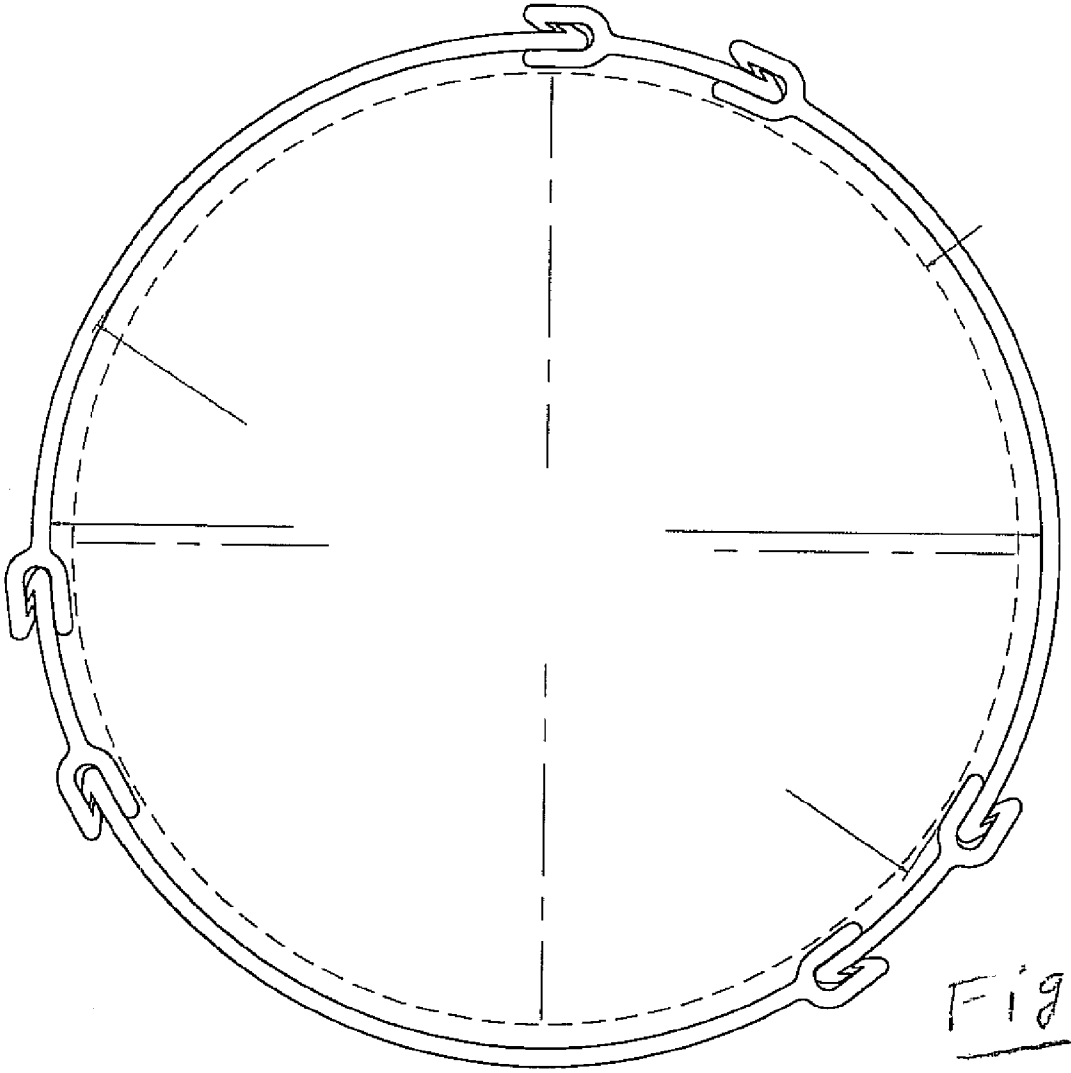
FIG. 5 shows a plurality of panels in cross section constructed in accordance with the panel interlocking mechanism of FIGS. 3A and 3B, including panels having different widths.

FIG. 3A is a cross section of an alternative panel interlocking mechanism according to the invention, and FIG. 3B shows the edges of two panels interlocked using the interlocking mechanism of FIG. 3A. In this embodiment, one edge includes a U-shaped cross-section 302 defining a channel 310 including a gap 308 with a lengthwise hook or barb 312. The opposing edge 306 includes a cooperating hook or barb 314 that interlocks as shown in FIG. 3B. As a further alternative, each edge may include a pair of interlocking barbs, as shown in FIG. 3C. FIG. 5 shows a plurality of panels in cross section constructed in accordance with the panel interlocking mechanism of FIGS. 3A and 3B, including panels having different widths.

Figure 4:
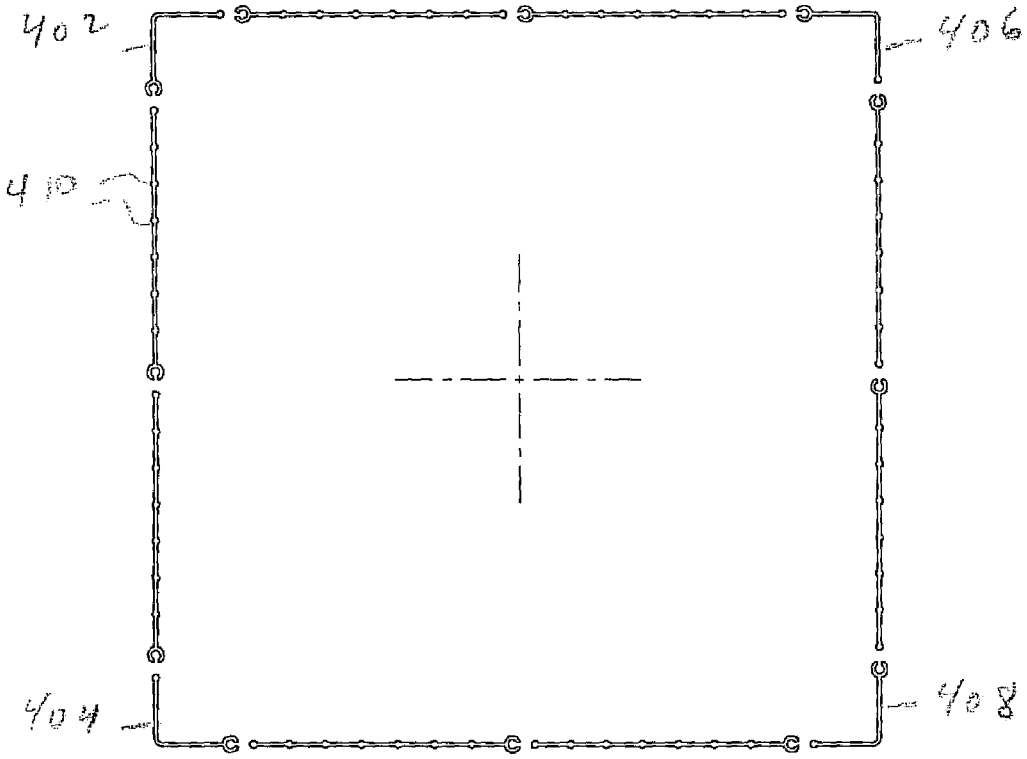
FIG. 4 shows a plurality of panels in cross section constructed in accordance with the panel interlocking mechanism of FIGS. 2A and 2B, including bent corner panels.

FIG. 4 shows a plurality of panels in cross section constructed in accordance with the panel interlocking mechanism of FIGS. 2A and 2B. This drawing shows the use of preformed corner panels 402, 404, 406, 408 bent at 90 degrees to form a cover having a square cross section. Other angular bends may alternatively be used such a 60 degrees to form a triangular cross section, 108 degrees to form a pentagonal, 120 degrees for a hexagonal shape, and so forth. It will also be appreciated that the panels may be used to form inside and outside corners; for example, 12 corner pieces may be used to construct cover with a cruciate cross section.

Also shown in FIG. 4 is the use of beads 410 which may be equally or unequally spaced apart. Such beads (or other raised ribs or depressions) may be used on any of the panels disclosed herein, including preformed curved or bent panels. Such beads may be purely decorative or, if they have the same cross section as the edge bead used to interconnection, a user may cut a panel immediately adjacent a bead lengthwise and shorten the width of that panel.

We claim:

1. A method of covering a vertical member, comprising the steps of:

a) providing a modular system for covering a vertical member, the system consisting of:

a plurality of identical, initially flat, flexible polymeric panels, each panel having a thickness, a length, and first and second opposing parallel side edges defining a width, the first side edge of each panel including a lengthwise receptacle, the second side edge of each panel including a lengthwise bead, and wherein the bead and receptacle are physically dimensioned such that the receptacle of one panel receives the bead of another panel in interlocking cooperation, thereby enabling multiple of the identical panels to be interconnected and flexed to surround a vertical member;

b) interconnecting the first edge of one of the panels to the second edge of a different one of the panels; and c) continuing the process of step b) until a vertical member is surrounded with the panels, with each panel being interconnected to two adjacent panels on either side thereof.

* * * * *